US007228870B1

(12) United States Patent
Sutera et al.

(10) Patent No.: US 7,228,870 B1
(45) Date of Patent: Jun. 12, 2007

(54) FUEL SAVING VALVE ASSEMBLY

(76) Inventors: Janet M. Sutera, 601 Stonehenge Dr., Vestal, NY (US) 13850; Kenneth A. Lyman, 730 Prescott Ave., Endicott, NY (US) 13760

( * ) Notice: Subject to any disclaimer, the term of this patent is extended or adjusted under 35 U.S.C. 154(b) by 808 days.

(21) Appl. No.: 10/307,576

(22) Filed: Dec. 2, 2002

(51) Int. Cl.
*F15K 15/04* (2006.01)

(52) U.S. Cl. ..... 137/539; 137/537; 222/571; 222/496

(58) Field of Classification Search ..... 137/537, 137/539, 539.5; 141/311 A, 392; 222/529, 222/571, 496
See application file for complete search history.

(56) References Cited

U.S. PATENT DOCUMENTS 1,379,474 A * 5/1921 Osborne ..... 137/537
2,004,203 A * 6/1935 Howell ..... 251/155
2,322,966 A * 6/1943 Oberly ..... 222/40
2,450,938 A * 10/1948 Copeland ..... 141/215
2,627,418 A * 2/1953 Ainsworth ..... 137/630.22
2,996,077 A * 8/1961 Taggert ..... 137/537
4,062,480 A * 12/1977 Bjorklund ..... 222/571
5,377,729 A * 1/1995 Reep ..... 141/392
5,704,522 A * 1/1998 Orgeolet et al. ..... 222/494

FOREIGN PATENT DOCUMENTS

DE 42 39 837 * 6/1994
EP 0 732 301 * 9/1996
FR 2 761 974 * 10/1998

* cited by examiner

*Primary Examiner*—Ramesh Krishnamurthy
(74) *Attorney, Agent, or Firm*—Mark Levy & Associates

(57) ABSTRACT

There is provided a one-way gasoline valve that is functional with conventional gasoline dispensing pumps in the United States today. An outer tubing body is open at both ends. One end is threaded to allow it to be placed into the end of a threaded gasoline dispensing pump nozzle assembly. A crossbar is provided, attached to a spring. This spring runs the length of the outer tubing, and has a large metal ball permanently attached to it at the end of the outer tubing body that is not threaded. This ball rests in position against a curved surface of the outer tubing that conforms to the curvature of the ball.

6 Claims, 4 Drawing Sheets

FUEL SAVING VALVE ASSEMBLY

FIELD OF THE INVENTION

The present invention relates to valves for preventing fluid loss and, more particularly, to valves used to prevent gasoline loss.

BACKGROUND OF THE INVENTION

In the United States, well over 100 million automobiles and 50 million trucks are in use. Moreover, millions of motor boats are used at least seasonally every year. The result is a large number of vehicles that must be filled with liquid fuel, such as gasoline, oil, or a mixture of both. In the process of filling these vehicles, a small amount of gasoline is inevitably released even after the pump has been shut off. The result is a small degree of spillage of the gasoline on the ground, water, or the exterior of the vehicle. Multiply this small amount of gasoline loss for each car and truck and boat by the total number of individuals experiencing this spillage and we have an unbelievably large amount of gasoline being lost. This gasoline spillage is damaging to the environment. Both the liquid and the gasoline fumes are potentially hazardous to the environment. Moreover, such spillage of fuel is wasteful of our natural resources.

Although there exist several varieties of one-way valves for liquids, none of these specifically addresses the need to prevent gasoline leakage from common, everyday gasoline pumps.

None of the previously produced one-way valves addresses the specific problem of leakage from a conventional gasoline dispensing pump. These previously produced one-way valves do not have dimensions that allow them to be used, without equipment modification, with a standard gasoline pump and automobile filling pipes.

It is an object of the invention to provide a one-way gas valve that allows gasoline to pass through it only when the gasoline pump is in operation.

It is a further object of the invention to provide easy compliance with conventional gasoline dispensing pump nozzle assemblies.

SUMMARY OF THE INVENTION

In accordance with the present invention, there is provided a one-way gasoline valve that is functional with gasoline pumps in the United States today. A hollow, tube-shaped body is open at both ends. One end is threaded to allow it to be placed into the end of a threaded gasoline dispensing pump nozzle. Attached to an interior crossbar is a spring. This spring runs the length of the hollow outer tubing, and has a large metal ball permanently attached to the end that is not threaded. This ball rests in position against a curved surface, at the non-threaded end of the outer tubing, the curved surface conforming to the curvature of the ball.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

The present invention is a gas saving device to be marketed under the trademark GaSaver and used with a conventional gas dispensing pump handle. The device includes a valve ball 26 that automatically shuts off the flow of fluid (e.g., liquid fuel, such as liquid gasoline) upon release of the flow operating lever 18.

Figure 1:
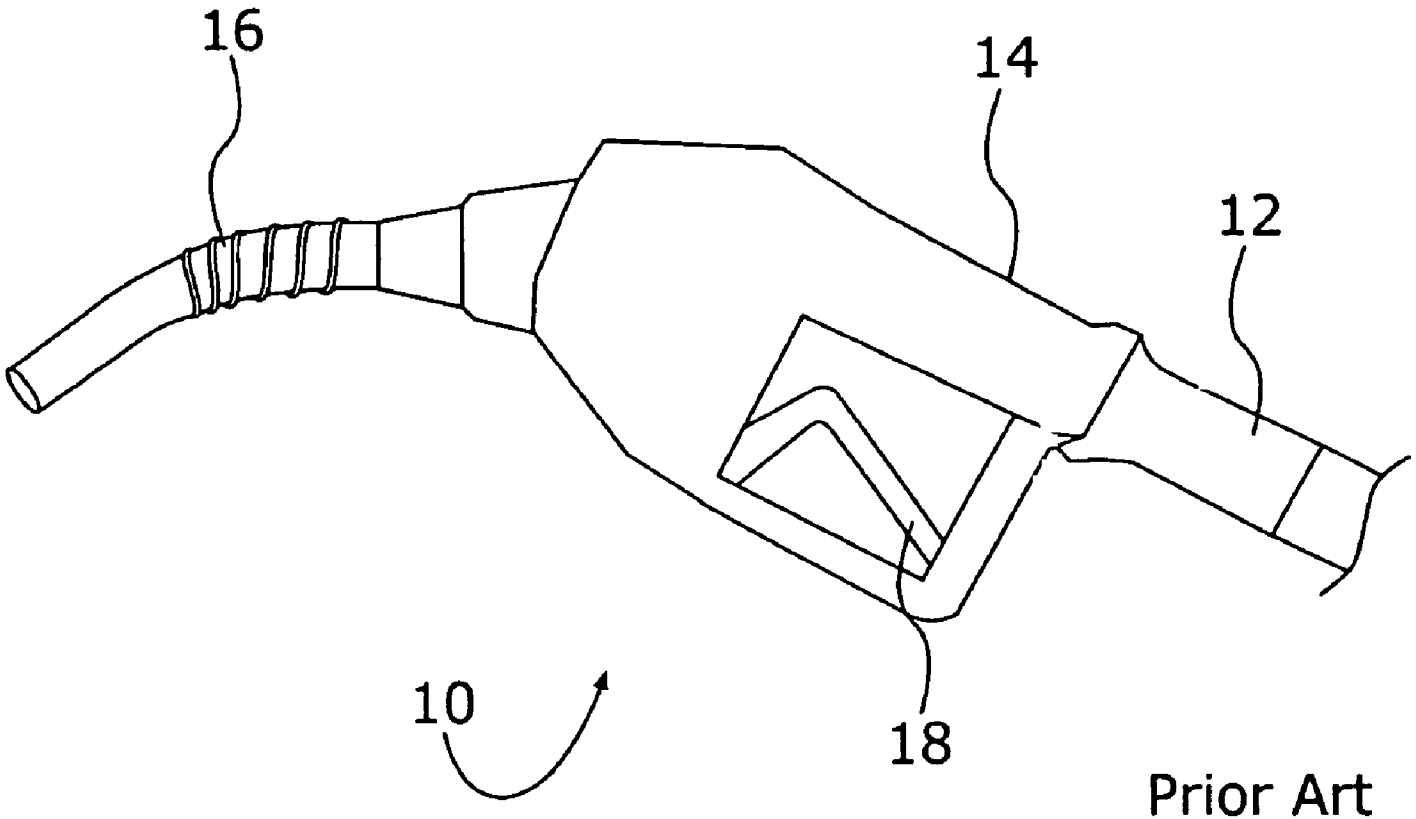
FIG. 1 is a perspective view of a conventional gas dispensing pump nozzle assembly.

FIG. 1 is a perspective view of a conventional gas dispensing pump nozzle assembly 10. A hose 12 is connected to the assembly 10 in a manner well known to those skilled in the art. The body 14 of assembly 10 has a spout or nozzle 16 extending therefrom. The nozzle 16 is adapted to be inserted into the filler tube of a gas tank of a motor vehicle, not shown. Liquid fuel, not shown, is caused to flow from hose 12 through body 14 and through nozzle 16 by means of a flow operating lever 18, which opens a valve, not shown, in the handle of gas dispensing pump nozzle 16 assembly.

Figure 2:
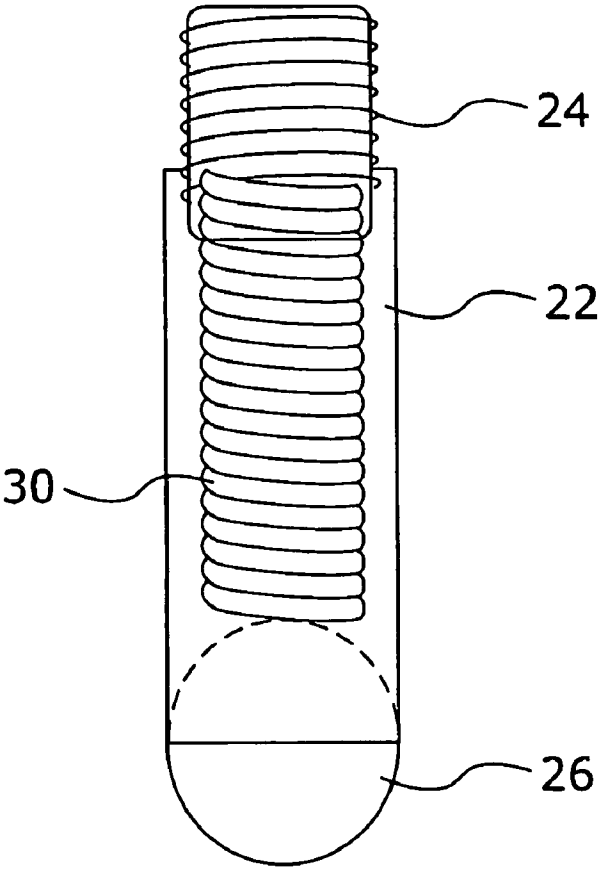
FIG. 2 is a perspective view of a GaSaver device of the present invention.
Figure 6:
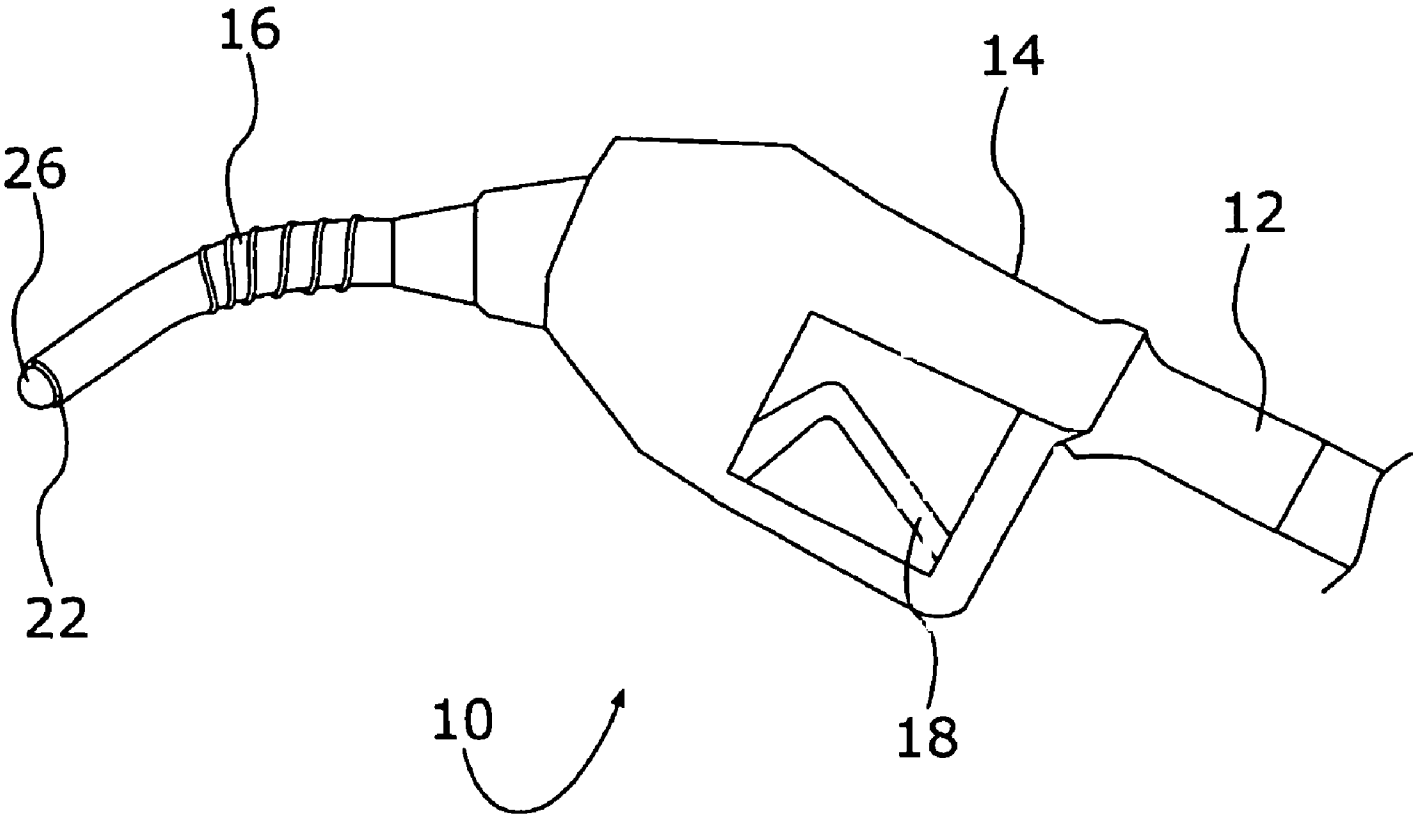
FIG. 6 is a perspective view of a gas dispensing pump nozzle assembly having a GaSaver device installed therein.

Referring now to FIG. 2, there is shown a GaSaver device 20 in accordance with the invention and shown in situ (FIG. 6). Outer tubing 22, comprising metal, plastic, rubber or other suitable material having a relative high durometer, is disposed proximate a connector 24 at a distal end of outer tubing 22. A valve ball 26, discussed in greater detail hereinbelow, is disposed at a proximal end of outer tubing 22. The connector 24 is adapted to be inserted in and threaded to a conventional gas dispensing pump nozzle assembly 10, mating with the nozzle 16 thereof. Therefore, connector 24 has a size suitable for fitting into nozzle 16 of standard gas dispensing pump nozzle 16 assembly. The inner diameter of nozzle 16 is approximately 9/16 inches. The connector 24 is attached to outer tubing 22 by welding or mechanically fastening in a manner well known to those skilled in the art. The outside diameter of outer tubing 22 is approximately equal to the inside diameter of gas dispensing pump nozzle 16 assembly to permit the GaSaver device 20 to be fit into the automobile gasoline tank filler tube.

At the proximal end of GaSaver device 20, valve ball 26 is attached to a metal, coil spring 30 by welding or mechanically fastening in a manner well known to those skilled in the art. It should be understood, however, that spring 30 need not be a coil spring 30, but must provide resiliency to valve ball 26. Moreover, spring 30 need not be metallic. The spring 30 is also attached to a crossbar 28 by welding or mechanically fastening in a manner well known to those skilled in the art. The spring 30 is of a tension that allows valve ball 26 to open when pressure of the fuel is applied thereto.

Permanently connected to the distal end of outer tubing 22 is crossbar 28, as mentioned hereinabove. The spring 30 is thereby seated relative to GaSaver device 20 by means of crossbar 28. The crossbar 28 is preferably fabricated from metal or other suitable material.

Figure 3:
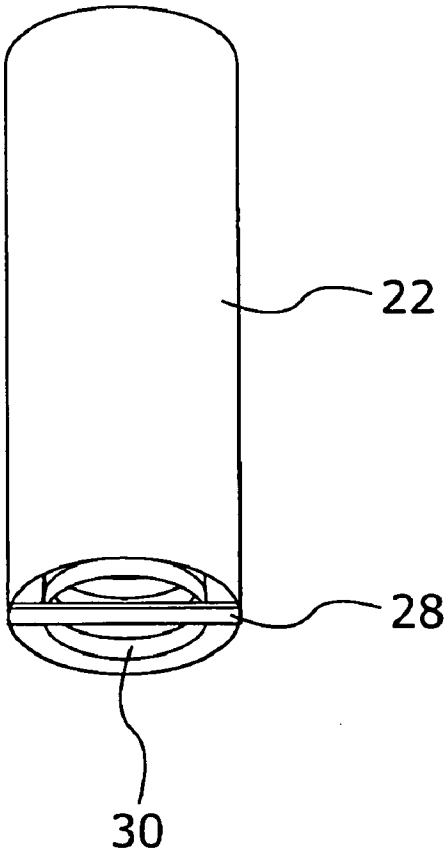
FIG. 3 is a top view of a GaSaver device showing a crossbar.

FIG. 3 is an enlarged, top perspective view of the GaSaver device 20 with the threaded portion not shown in FIG. 1. Attached to crossbar 28 is spring 30 with openings on either side of crossbar 28 to allow for gasoline flow through outer tubing 22, flowing over spring 30, from threaded, distal end of outer tubing 22 to proximal end of outer tubing 22, as shown by arrow 60.

Figure 4:
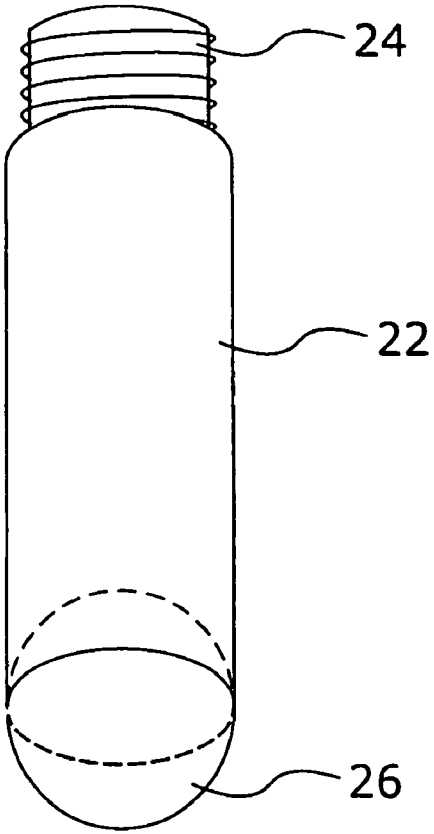
FIG. 4 is a bottom view of a GaSaver device showing the valve ball in its closed position.

FIG. 4 is an enlarged, bottom perspective view of GaSaver device 20 with spring 30 compressed and valve ball 26 in the closed position, as shown in FIG. 2. This is the quiescent condition, when fuel is not allowed to flow through nozzle 16, due to flow operating lever 18 being deactivated. In this position, valve ball 26 forms a substantially tight seal with the proximal end of outer tubing 22, thus preventing fuel from leaking therefrom.

Figure 5:
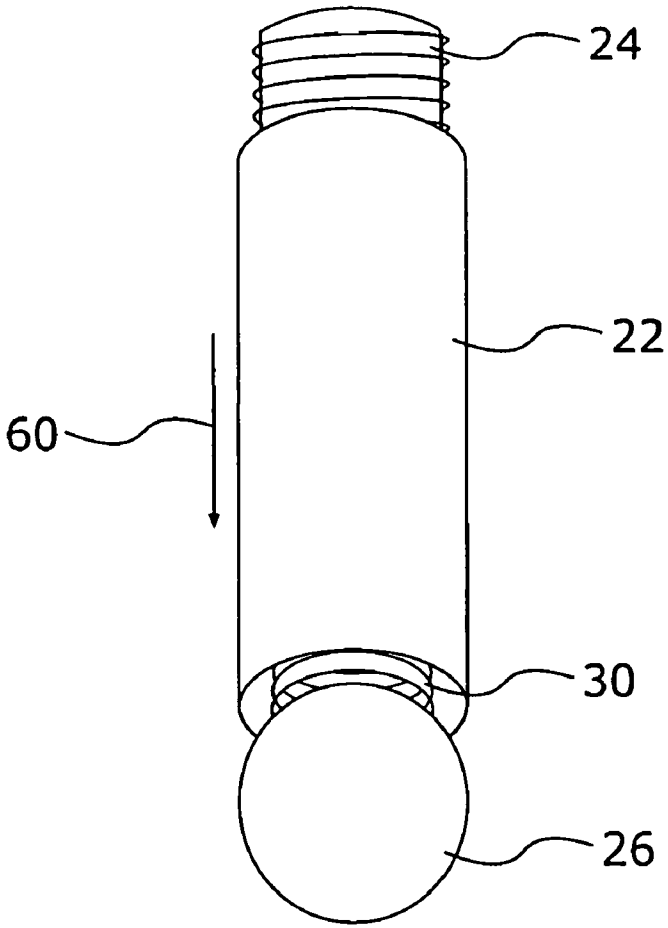
FIG. 5 is a bottom view of a GaSaver device with the ball valve shown in its open position.

FIG. 5 is an enlarged, bottom perspective view of GaSaver device 20 with spring 30 expanded and valve ball 26 in the open position. This is the active condition, when fuel is permitted to flow through nozzle 16, due to flow operating lever 18 being activated (i.e., retracted). In this position, valve ball 26 is forced to move in the direction of the fuel flow, arrow 60, stretching spring 30 and moving away from the proximal end of outer tubing 22, thus allowing fuel to flow freely into the filler tube of the vehicle.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A fuel saving valve assembly for preventing excess gas leakage at conventional gasoline dispensing pumps comprising:

an outer tubing having a distal end and a proximal end and a uniform inner diameter;

a spring having a distal end and a proximal end disposed within said outer tubing, said spring having a predetermined tension such that it can be extended by pressure of gasoline applied thereto;

a rigid crossbar, for holding said distal end of said spring, operatively connected to said spring and operatively connected to said distal end of said outer tubing; and a substantially spherical, metallic valve ball having a diameter greater than said predetermined inner diameter, said metallic valve ball being connected to said proximal end of said spring, for forming a tight seal, in its quiescent state, between said ball and said proximal end of said outer tubing, and, when gasoline pressure is applied thereto, for creating a gap between said metallic valve ball and said proximal end of said outer tubing so as to allow said gasoline to flow freely into the filler tube of a vehicle.

2. The fuel saving valve assembly as recited in claim 1, further comprising:

a connector, for coupling with a nozzle of a conventional gas dispensing pump, rigidly connected to said distal end of said outer tubing.

3. The fuel saving valve assembly as recited in claim 1, wherein said outer tubing is metal.

4. The fuel saving valve assembly as recited in claim 2, wherein said connector has at least one characteristic selected from the following group: male, and threaded.

5. The fuel saving valve assembly as recited in claim 1, wherein said crossbar has at least one characteristic selected from the following group: flat, metal, and plastic.

6. The fuel saving valve assembly for preventing excess gas leakage at conventional gasoline dispensing pumps comprising:

a male, threaded connector, for coupling with a nozzle of a conventional gas dispensing pump;

a metal, coil, resilient, hollow spring with a distal end and a proximal end, for allowing expansion as gasoline flows and for allowing contraction as gasoline flow ceases;

a metal outer tubing having a distal end and a proximal end, for allowing gasoline to flow while said spring is expanded, said distal end of said metal outer tubing being rigidly connected to said connector;

a crossbar, for holding said distal end of said spring, rigidly connected to said distal end of said outer tubing, and rigidly connected to said distal end of said spring; and a substantially spherical valve ball connected to said proximal end of said spring, for forming a tight seal, in its quiescent state, between said ball and said proximal end of said outer tubing, and, when gasoline pressure is applied thereto, for creating a gap between said valve ball and said proximal end of said outer tubing so as to allow said gasoline to flow freely into the filler tube of a vehicle.

* * * * *